US009554649B2

(12) United States Patent
Saich et al.

(10) Patent No.: US 9,554,649 B2
(45) Date of Patent: Jan. 31, 2017

(54) MODULAR FRAMEWORK SUPPORT SYSTEMS

(71) Applicant: BIG FOOT SYSTEMS LIMITED, Hailsham (GB)

(72) Inventors: Claire Louise Saich, Hailsham (GB); Joseph Nicholas Rose, Hailsham (GB)

(73) Assignee: Big Foot Systems Limited, Hailsham (GB)

( * ) Notice: Subject to any disclaimer, the term of this patent is extended or adjusted under 35 U.S.C. 154(b) by 0 days.

(21) Appl. No.: 14/419,027

(22) PCT Filed: Jul. 26, 2013

(86) PCT No.: PCT/GB2013/052006
§ 371 (c)(1),
(2) Date: Feb. 2, 2015

(87) PCT Pub. No.: WO2014/020321
PCT Pub. Date: Feb. 6, 2014

(65) Prior Publication Data

US 2015/0189988 A1 Jul. 9, 2015

(30) Foreign Application Priority Data

Aug. 2, 2012 (GB) ..... 1213736.0

(51) Int. Cl.
*A47B 91/12* (2006.01)
*A47B 91/00* (2006.01)
(Continued)

(52) U.S. Cl.
CPC ..... *A47B 91/005* (2013.01); *A47B 96/14* (2013.01); *F24F 13/32* (2013.01); *H01Q 1/12* (2013.01);
(Continued)

(58) Field of Classification Search
CPC ..... F16M 13/00; A47B 91/005; A47B 96/14; A47B 91/12; F24F 13/32
(Continued)

(56) References Cited

U.S. PATENT DOCUMENTS 3,570,414 A * 3/1971 Miller ..... B61D 45/001 410/153
4,269,010 A * 5/1981 Glass ..... E04H 17/08 52/154
(Continued)

FOREIGN PATENT DOCUMENTS

DE 8535843 U1 3/1986
DE 202012008431 * 11/2012 ..... F24F 13/02
(Continued)

*Primary Examiner* — Michael Safavi
(74) *Attorney, Agent, or Firm* — Peter A. Nieves; Sheehan Phinney Bass & Green PA

(57) ABSTRACT

The present invention relates to modular framework support systems. In particular, it relates to framework support systems of the non-penetrative type particularly used for supporting heating and ventilating apparatus and other service and plant apparatus on a roof of a building. The application describes a support (10) for a modular framework system, the support comprising a planar foot (11) comprising a socket (12) having a substantially rectangular cross-section with a long axis and a short axis. The socket has a base and an opening. The socket is provided with one or more elongate ribs (25) between the base and the opening and extending into the socket. The socket further comprises a projection (20) extending upwardly from the base, the projection having a spine (21) aligned with the long axis of the socket. Preferably, each rib (25) has a stepped configuration such that an operatively lower portion of the rib extends further into the socket than an operatively upper portion of the rib.

6 Claims, 6 Drawing Sheets

(51) Int. Cl.

| | |
|---|---|
| ***F24F 13/32*** | (2006.01) |
| ***H01Q 1/12*** | (2006.01) |
| ***A47B 96/14*** | (2006.01) |
| *E04H 12/22* | (2006.01) |

(52) U.S. Cl.
CPC ..... *E04H 12/2261* (2013.01); *E04H 12/2269* (2013.01)

(58) Field of Classification Search
USPC ..... 248/346.01, 346.11, 346.5; D25/133
See application file for complete search history.

(56) References Cited

U.S. PATENT DOCUMENTS

| | | | | | |
|---|---|---|---|---|---|
| 5,197,819 | A * | 3/1993 | Hughes | 116/63 R | |
| 5,427,342 | A | 6/1995 | Gagnon | | |
| 5,560,588 | A | 10/1996 | Hilliard | | |
| 5,878,984 | A * | 3/1999 | Grieser | A47B 91/00 | 248/188.8 |
| D433,615 | S * | 11/2000 | Neider | D8/354 | |
| 6,141,928 | A * | 11/2000 | Platt | E04F 11/1812 | 256/65.14 |
| D463,250 | S * | 9/2002 | Valentz | D8/349 | |
| 6,948,283 | B2 * | 9/2005 | Burkart | B29C 33/005 | 248/346.01 |
| 7,722,014 | B2 * | 5/2010 | Godwin | E04C 3/32 | 248/523 |
| 8,141,830 | B1 * | 3/2012 | Hudson | E04G 21/1808 | 248/188 |
| 2007/0187564 | A1 * | 8/2007 | McGuire | E02D 27/42 | 248/346.5 |
| 2007/0235616 | A1 * | 10/2007 | Gross | E04H 12/2261 | 248/346.5 |
| 2010/0038516 | A1 | 2/2010 | Trueb | | |
| 2014/0311068 | A1 * | 10/2014 | Takagi et al. | 52/295 | |

FOREIGN PATENT DOCUMENTS

| | | | | |
|---|---|---|---|---|
| GB | 2396181 A | | 6/2004 | |
| WO | WO 2014/020322 | * | 2/2014 | F24F 13/32 |

* cited by examiner

FIG.1
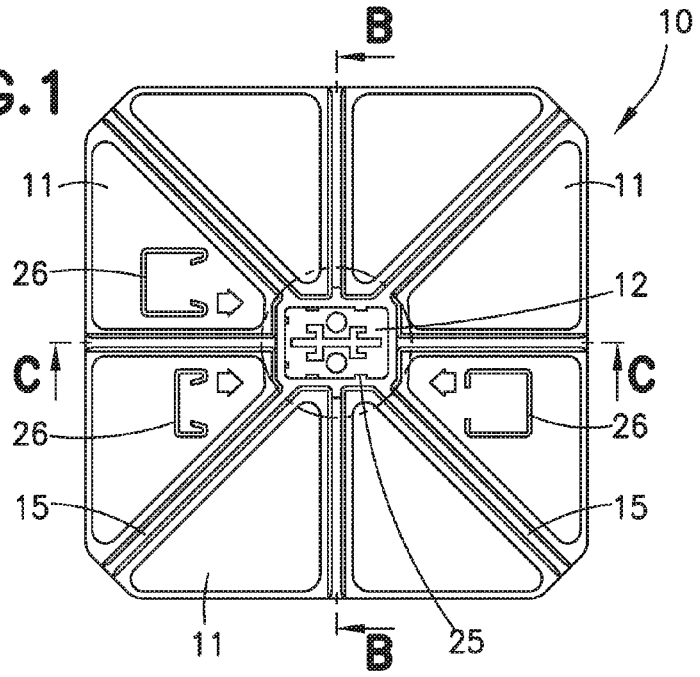
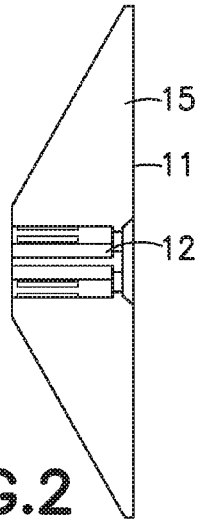
FIG.2
SECTION B–B
SCALE 1:3
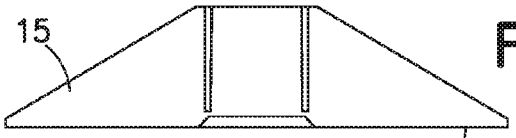
FIG.3
SECTION C–C
SCALE 1:3
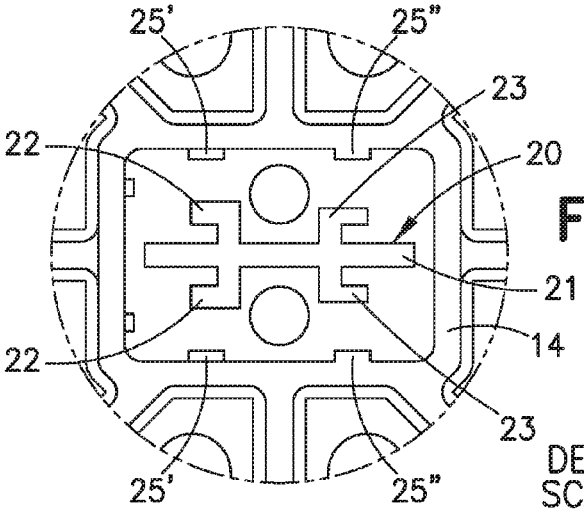
FIG.4
DETAIL A
SCALE 1:1

MODULAR FRAMEWORK SUPPORT SYSTEMS

The present invention relates to modular framework support systems. In particular, it relates to framework support systems of the non-penetrative type particularly used for supporting heating and ventilating apparatus and other service and plant apparatus on a roof of a building.

Modular framework support systems comprising a series of U-shaped channeled struts assembled into a framework are well known for supporting air conditioning and other plant apparatus on a roof of a building and spacing the plant from the roof material. There are many suppliers of such systems, but the components are typically not interchangeable. Two such manufacturers are Unistrut and Eurostrut (registered trade marks). The frameworks are also used in other areas, such as in suspending pipes and electrical cables from ceilings. However, when used to support plant on a roof, the systems require relatively large feet into which upright struts are placed in order to spread the weight of the framework and the supported plant and equipment over the surface of the roof. Single feet are known which are suitable to use with a range of strut sizes, but have an oversized socket in which the strut is held in place by a collar, but this arrangement can be difficult to manipulate during assembly of a framework construction and requires a range of collars to maintained in stock to suit every possible strut combination likely to be used. The present invention seeks to overcome this problem.

Accordingly, in its broadest sense, the present invention provides a support for a modular framework system, the support comprising a planar foot comprising a generally rectangular socket having a base and an opening, wherein each socket is provided with one or more elongate ribs between the base and the opening and extending into the socket. In preferred embodiments, the socket further comprises a projection extending upwardly from the base, the projection having a spine aligned with the long axis of the socket.

The rectangular cross-section of the socket preferably has adjacent sides or walls of unequal length.

Preferably, each rib has a stepped configuration such that an operatively lower portion of the rib extends further into the socket than an operatively upper portion of the rib.

Suitably, the spine includes at least one pair of fingers extending laterally therefrom, one finger on each side of the spine.

The above and other aspects of the present invention will now be described in further detail, by way of example only, with reference to the accompanying drawings, in which:

FIG. 1 is a plan view of an embodiment of a modular framework support base in accordance with the present invention;

FIG. 2 is a cross-sectional view along line B-B of FIG. 1;

FIG. 3 is a cross-sectional view along line C-C of FIG. 1;

FIG. 4 is a detail of the plan view of FIG. 1;

Figure 5:
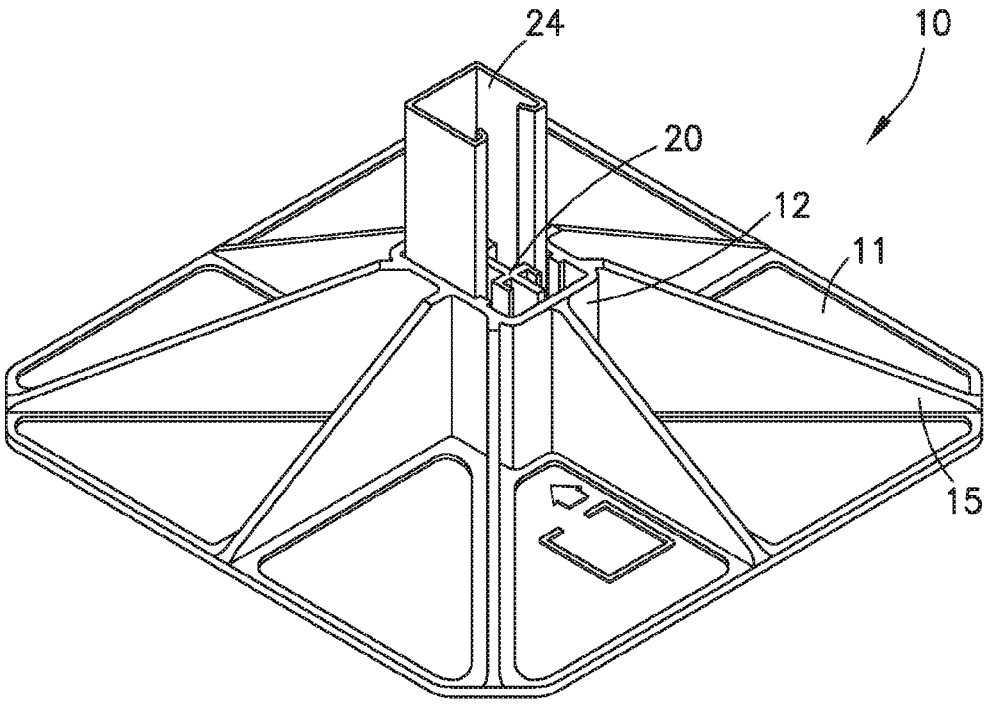
FIG. 5 is a perspective view of the base of FIG. 1 with a first framework channel.

With reference to the figures, an embodiment of a modular framework support base 10 is shown having a generally planar foot 11 with a generally centrally positioned socket 12 extending upwardly therefrom. Socket 12 is generally of a rectangular cross-section having opposed longer walls 13 defining a long axis of the socket 12 and opposed shorter walls 14 defining a short axis. Reinforcing ribs 15 are provided between socket 12 and foot 11.

Suitably, the base is formed as a unitary element by injection moulding of a suitable plastics material, such as glass-filled nylon.

As illustrated most clearly in FIG. 4, socket 12 has a projection 20 extending upwardly from a base of the socket. Projection 20 has a spine 21 aligned with the long axis of the socket. Extending laterally from spine 21 are fingers 22,23 arranged in two pairs, each pair towards a respective short wall 14 of socket 12.

In the embodiment shown, fingers 22,23 are formed having a 90° bend. In alternative embodiments, not shown, fingers 22,23 are solid projections extending laterally from spine 21. Indeed, it will be appreciated that projection 20 can be moulded with a spine 21 having the required dimensions without the need for discrete fingers.

Short walls 14 are dimensioned to match the maximum width dimensions of Unistrut (41 mm) and Eurostrut (40 mm) respectively. It will be appreciated that embodiments of the present invention can be manufactured to fit any form of strut. Unistrut channels are formed to a wide range of designs, but typically conforming to two cross-sectional box sizes, 41 mm×41 mm and 41 mm×21 mm and are manufactured in several gauges, typically 12 gauge (2.66 mm), 14 gauge (1.90 mm) and 19 gauge (1.00 mm).

Figure 6:
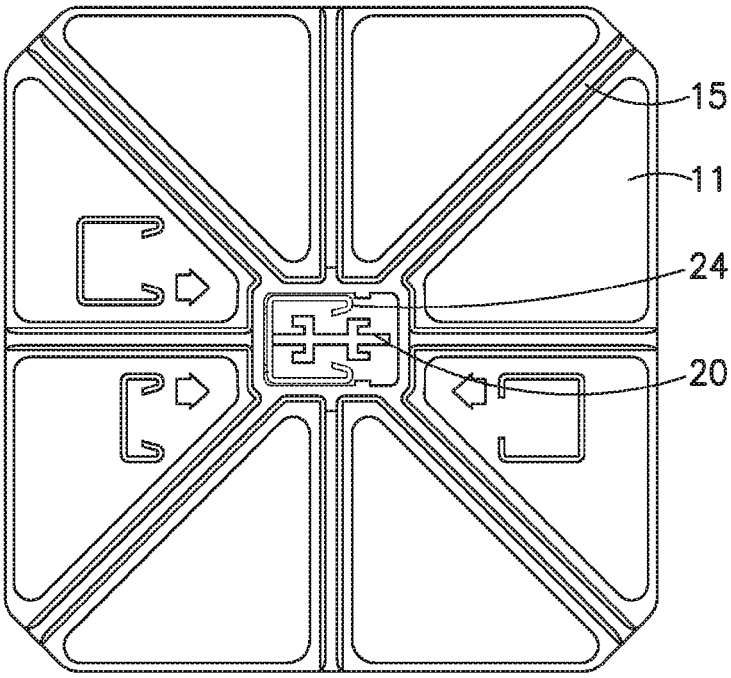
FIG. 6 is a plan view of the arrangement of FIG. 5.
Figure 7:
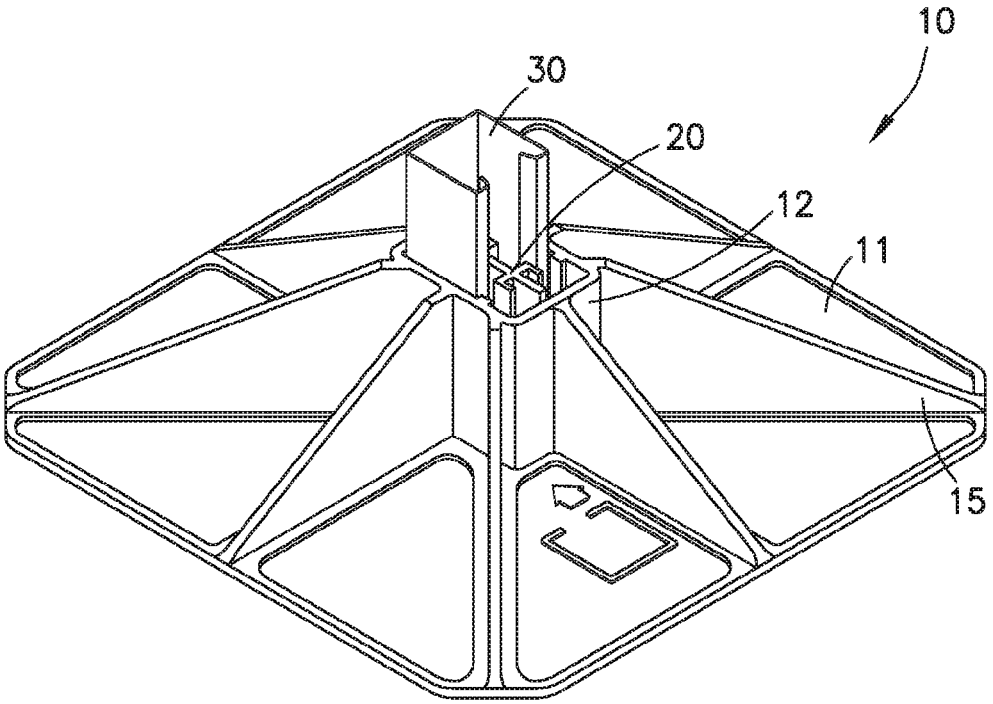
FIG. 7 is a perspective view of the base of FIG. 1 with a second framework channel.
Figure 8:
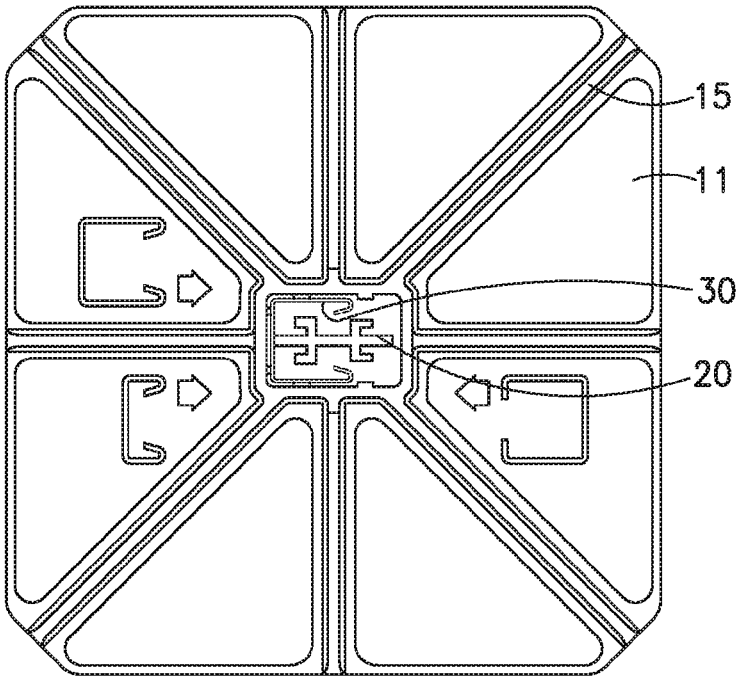
FIG. 8 is a plan view of the arrangement of FIG. 7.

Short wall 14 of socket 12 is suitably formed to have a dimension slightly larger than the 41 mm dimension of the larger Unistrut channel 24 (FIG. 5). Thereby, the large channel strut 24 can be inserted into socket 12 as shown in FIGS. 5 to 13. FIGS. 5 and 6 show the thicker gauge Unistrut channel and FIGS. 7 and 8 show the thinner gauge.

In accordance with a preferred feature of the present invention, long and short walls 13,14 of socket 12 are each provided with one or more vertical elongate ribs 25 extending into the socket. Ribs 25 advantageously include a stepped portion such that an operatively lower portion of each rib 25 extends further into socket 12 than does an upper portion. Ribs 25 act to hold channel 24 securely and the stepped portion allow the single socket design to hold both or all gauges of channel equally securely.

As illustrated, ribs 25 are suitably formed as opposed matching pairs 25', 25". Each pair corresponds with a particular choice of strut. For example, in the embodiment shown, as illustrated in FIG. 4, the right hand side of socket 12 is intended for receipt of a 40 mm Eurostrut channel whereas that on the left hand side is intended for receipt of a 41 mm Unistrut channel. Accordingly, the ribs of rib pair 25" associated with the Eurostrut channel are formed to be 1 mm larger than rib pair 25' associated with the larger Unistrut channel. As can be seen in FIG. 1, conveniently, the profiles of the appropriate strut channels can be moulded as icons 26 into the base to indicate the correct positioning and orientation of the strut channel.

Figure 9:
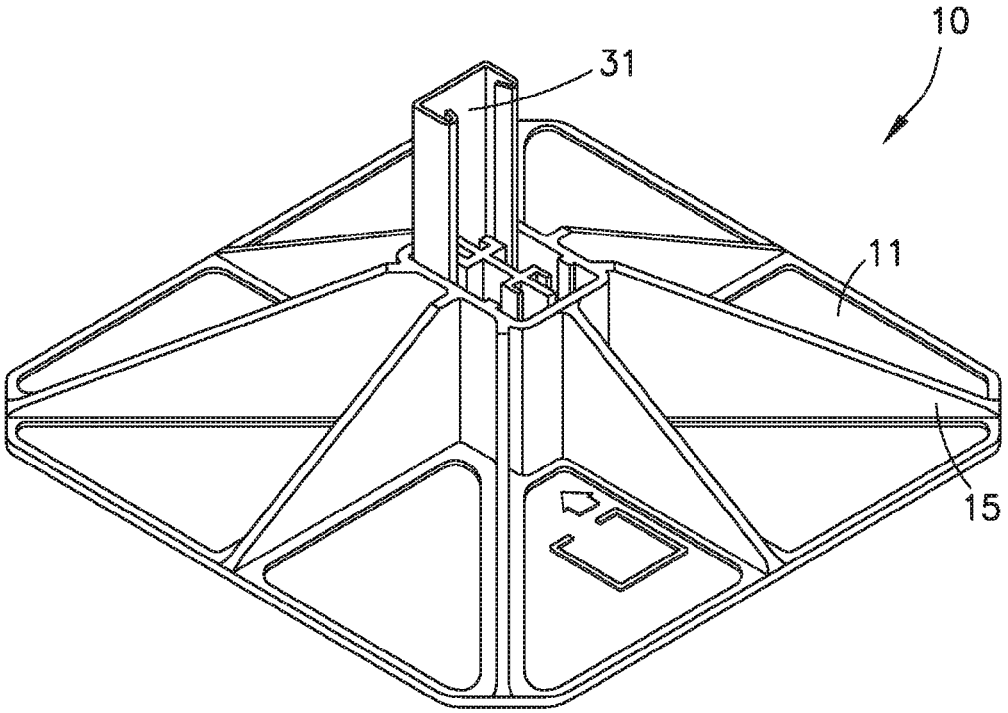
FIG. 9 is a perspective view of the base of FIG. 1 with a third framework channel.
Figure 10:
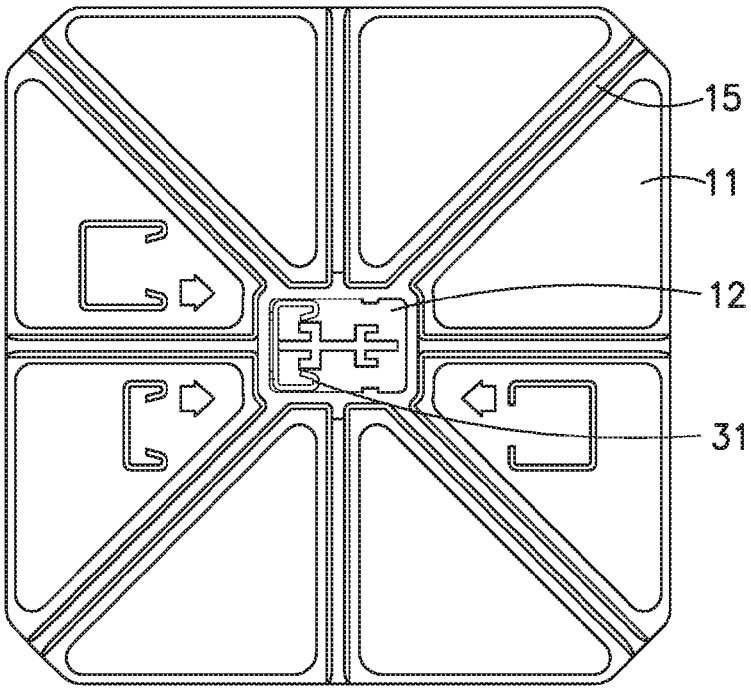
FIG. 10 is a plan view of the arrangement of FIG. 9.

FIGS. 5 and 6 show the embodiment of the base with a large, heavy gauge Unistrut channel 24. FIGS. 7 and 8 show the same base with a lighter gauge Unistrut 30. FIGS. 9 and

Figure 11:
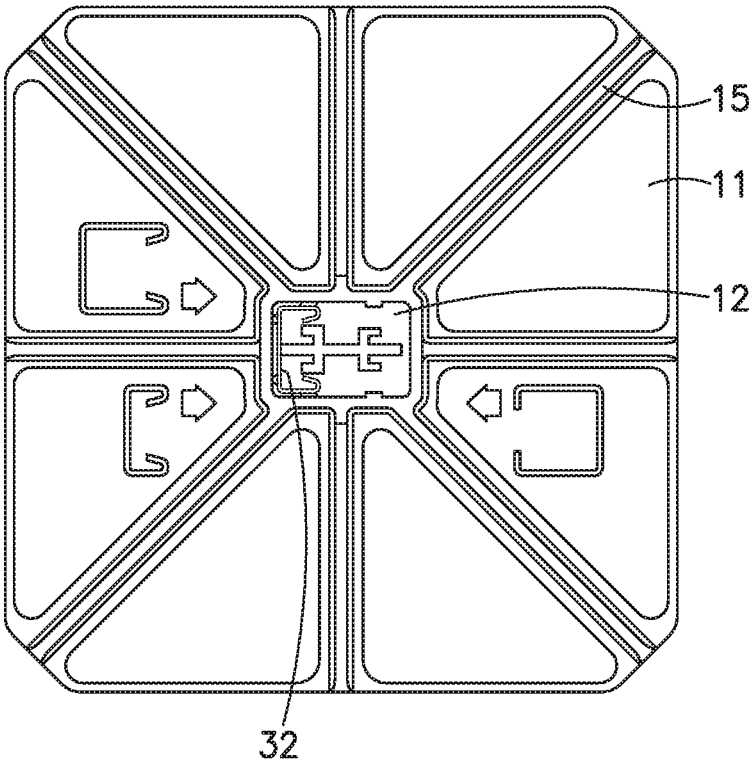
FIG. 11 is a plan view of the base of FIG. 1 with a fourth framework channel.

10 show the base with the shorter (21 mm) walled heavy gauge Unistrut 31 and FIG. 11 shows the lighter gauge short walled Unistrut 32.

Figure 12:
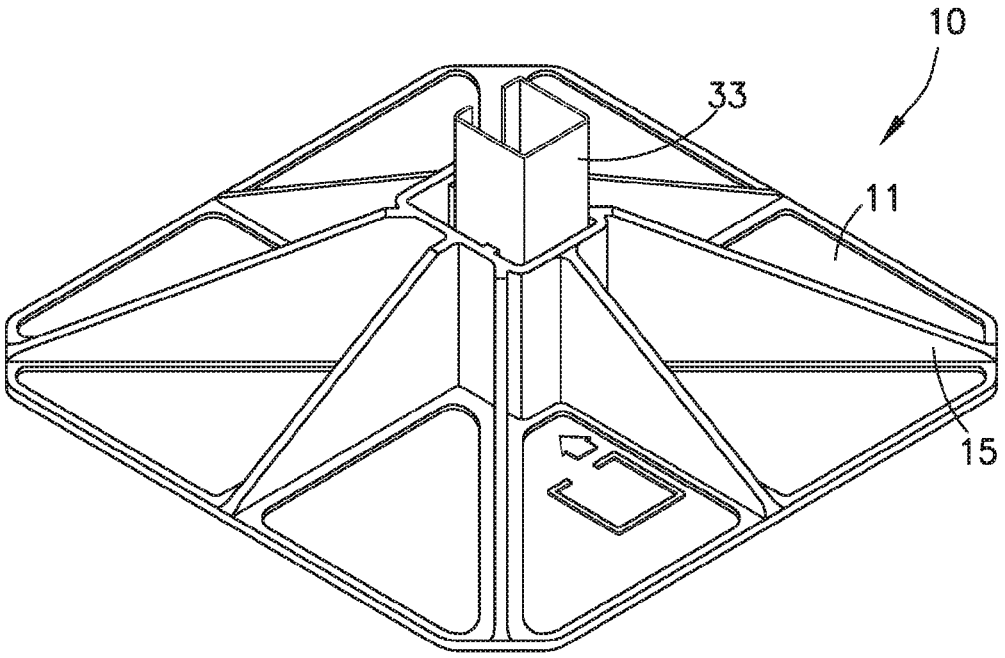
FIG. 12 is a perspective view of the base of FIG. 1 with a fifth framework channel.
Figure 13:
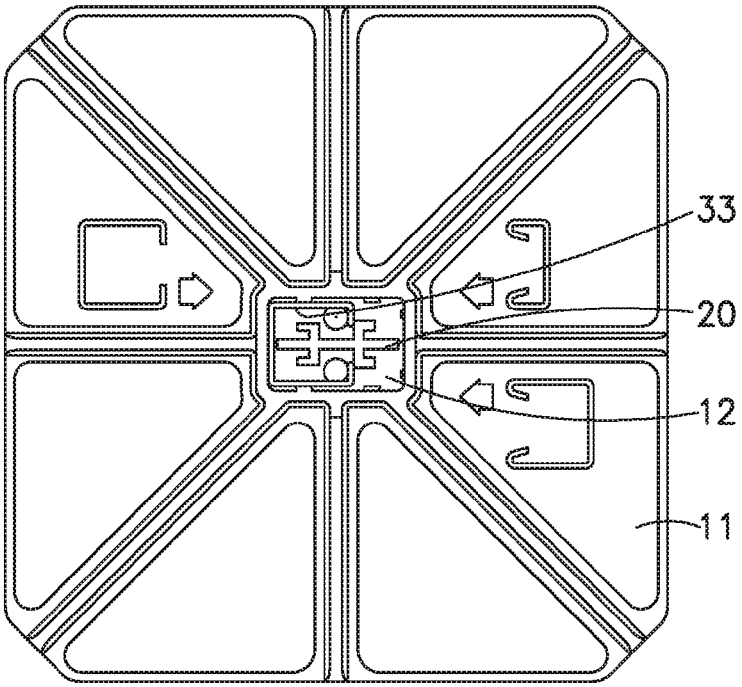
FIG. 13 is a plan view of the arrangement of FIG. 12.

FIGS. 12 and 13 then show the same embodiment of the base with a standard Eurostrut channel 33.

It can be seen from a comparison of the plan views of the figures that fingers 22,23 are suitably dimensioned to correspond substantially to the spacing between the open edges of the strut channel which will, in use, be generally adjacent to the respective fingers 22,23. Although not essential for structural strength in an assembled framework construction, projection 20 and fingers 22,23 provide support and alignment to the strut during assembly of the framework.

It will therefore be appreciated that, in accordance with the present invention, a single base unit can be used with a range of strut channels of different dimensions without the need for a range of plastic inserts or other fillers to be kept in stock.

The invention claimed is:

1. A support for a modular framework system, the support comprising:

a planar foot;

a socket extending upwardly from the foot and having a substantially rectangular cross-section formed by opposed longer walls and opposed shorter walls extending upwardly from the foot, wherein the opposed longer walls define a long axis of the socket and the opposed shorter walls define a short axis of the socket, wherein the socket has a base and an opening and is provided with one or more elongate ribs between the base and the opening and extending into the socket, wherein each rib has a stepped configuration such that an operatively lower portion of the rib extends further into the socket than an operatively upper portion of the rib, and wherein the socket further comprises a projection extending upwardly from the base of the socket substantially the same height as the height of the longer and shorter walls, the projection having a spine aligned with the long axis of the socket.

2. A support as claimed in claim 1 wherein the spine includes at least one pair of fingers extending laterally therefrom, one finger on each side of the spine.

3. A support as claimed in claim 2 wherein each finger has a 90 degree bend.

4. A support for a modular framework system, the support comprising:

a planar foot;

a socket extending upwardly from the foot and having a substantially rectangular cross-section formed by opposed longer walls and opposed shorter walls extending upwardly from the foot, wherein the opposed longer walls define a long axis of the socket and the opposed shorter walls define a short axis of the socket, wherein the socket has a base and an opening and is provided with one or more elongate ribs between the base and the opening and extending into the socket, and wherein the socket further comprises a projection extending upwardly from the base of the socket substantially the same height as the height of the longer and shorter walls, the projection having a spine aligned with the long axis of the socket; and a channeled strut inserted in the socket of the support, wherein the strut has a U-shaped cross-section and the projection extends into the U-shaped cross-section to provide support and alignment to the strut.

5. A support as claimed in claim 4 wherein the spine includes at least one pair of fingers extending laterally therefrom, one finger on each side of the spine.

6. A support as claimed in claim 5 wherein each finger has a 90 degree bend.

* * * * *